US007130562B2

(12) United States Patent
Foster et al.

(10) Patent No.: US 7,130,562 B2
(45) Date of Patent: Oct. 31, 2006

(54) COUPLING RETRACTION MECHANISM FOR AN IMAGE FORMING DEVICE

(75) Inventors: Larry Steven Foster, Lexington, KY (US); Edward Lawrence Kiely, Lexington, KY (US); Robert Galon Newman, Lexington, KY (US); Harald Portig, Versailles, KY (US); David Erwin Rennick, Georgetown, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 47 days.

(21) Appl. No.: 10/810,139

(22) Filed: Mar. 26, 2004

(65) Prior Publication Data

US 2005/0214023 A1 Sep. 29, 2005

(51) Int. Cl.
*G03G 21/18* (2006.01)
*G03G 15/00* (2006.01)

(52) U.S. Cl. ..... 399/112; 399/110; 399/125

(58) Field of Classification Search ..... 399/110–114, 399/124, 125, 299
See application file for complete search history.

(56) References Cited

U.S. PATENT DOCUMENTS 5,262,824 A * 11/1993 Morita et al. ..... 399/25
5,374,982 A 12/1994 Boockkholdt
5,920,753 A 7/1999 Sasaki et al.
5,978,626 A * 11/1999 Nagamine et al. ..... 399/125
6,246,841 B1 * 6/2001 Merrifield et al. ..... 399/27
6,400,914 B1 6/2002 Noda et al.
6,453,135 B1 * 9/2002 Sameshima et al. ..... 399/110
6,484,003 B1 * 11/2002 Tokutake et al. ..... 399/110
6,522,861 B1 * 2/2003 Tokutake et al. ..... 399/401
6,785,492 B1 * 8/2004 Tanizaki et al. ..... 399/113
6,798,430 B1 * 9/2004 Sato ..... 347/115
6,799,011 B1 * 9/2004 Abe et al. ..... 399/299
6,968,143 B1 * 11/2005 Blair et al. ..... 399/124
2001/0026707 A1 10/2001 Miyabe
2002/0076235 A1 6/2002 Matsuzaki
2003/0185587 A1 * 10/2003 Kawai et al. ..... 399/111

* cited by examiner

*Primary Examiner*—Diego Gutierrez
*Assistant Examiner*—Dixomara Vargas
(74) *Attorney, Agent, or Firm*—Coats and Bennett, PLLC

(57) ABSTRACT

In an image forming apparatus containing a plurality of rollers disposed with generally parallel axes, a retraction plate containing a plurality of rotational couplings is movable between engaged and retracted positions. Each rotational coupling is operative to transmit a rotary force to each cartridge when the retraction plate is in the engaged position. The couplings move laterally in an axial direction of the rollers as the retraction plate moves between the engaged and retracted positions, in response to an applied force. In one embodiment, the retraction plate is rotated about a pivot point to move the couplings between engaged and retracted positions. In another embodiment, the retraction plate is translated laterally in the axial direction of the couplings.

40 Claims, 7 Drawing Sheets

COUPLING RETRACTION MECHANISM FOR AN IMAGE FORMING DEVICE

BACKGROUND

The present invention relates generally to the field of image formation devices and in particular to a coupling retraction mechanism for a color electrophotographic printer.

The use of removable cartridges in image formation devices is well known. Such cartridges typically include a photoconductive member upon which latent images are formed, as well as a reservoir of toner and rollers to apply toner to the photoconductive member to develop the latent image. A wide variety of designs and mechanisms are employed in the art for inserting and removing such cartridges. In particular, inserting a removable cartridge in an axial direction, whereby a drive receiver on the end of the cartridge mates with a rotary drive coupling as the cartridge is inserted, is well known in the art. Other insertion/removal means are known, whereby the cartridge is inserted/removed in a direction at right angles to the cartridge's rollers' axes. Such systems typically require a manual, mechanical decoupling of a rotary drive coupler from a drive receiver on the cartridge, to provide mechanical clearance for the insertion/removal of the cartridge.

Modern, compact, multicolor image formation devices typically include a plurality of removable cartridges, such as three or four, each supplying a different color of toner. One recent development in the image formation arts is the separation of the functions of toner supply, and image formation and transfer, into different removable cartridges. Such a system may include a large number (e.g., eight) separately removable cartridges, each of which must be mechanically coupled to the image forming device, to provide rotary power to the cartridge. Additionally, other elements in the image forming device may require decouplable rotary power.

SUMMARY

The present invention relates to an image forming apparatus containing a plurality of rollers disposed with generally parallel axes. A retraction plate is movable between engaged and retracted positions. A plurality of rotational couplings are retained axially by the retraction plate, with each rotational coupling operative to transmit a rotary force to each roller when the retraction plate is in the engaged position. The couplings move laterally in an axial direction of the rollers as the retraction plate moves between the engaged and retracted positions, in response to an applied force.

In another aspect, the present invention relates to a coupling retraction mechanism for an image forming apparatus. The mechanism includes a retraction plate movable between engaged and retracted positions. A plurality of rotational couplings retained axially by the retraction plate are operative to couple rotational forces to a corresponding plurality of rollers disposed in the image forming apparatus when the retraction plate is in the engaged position. The mechanism also includes an articulating member movable in a first lateral direction along the retraction plate in response to an applied force, wherein movement of the articulating member in the first lateral direction is operative to translate the retraction plate in a second lateral direction, generally orthogonal to the first lateral direction, thereby moving the plate between the retracted and engaged positions.

DETAILED DESCRIPTION OF THE INVENTION

Figure 1:
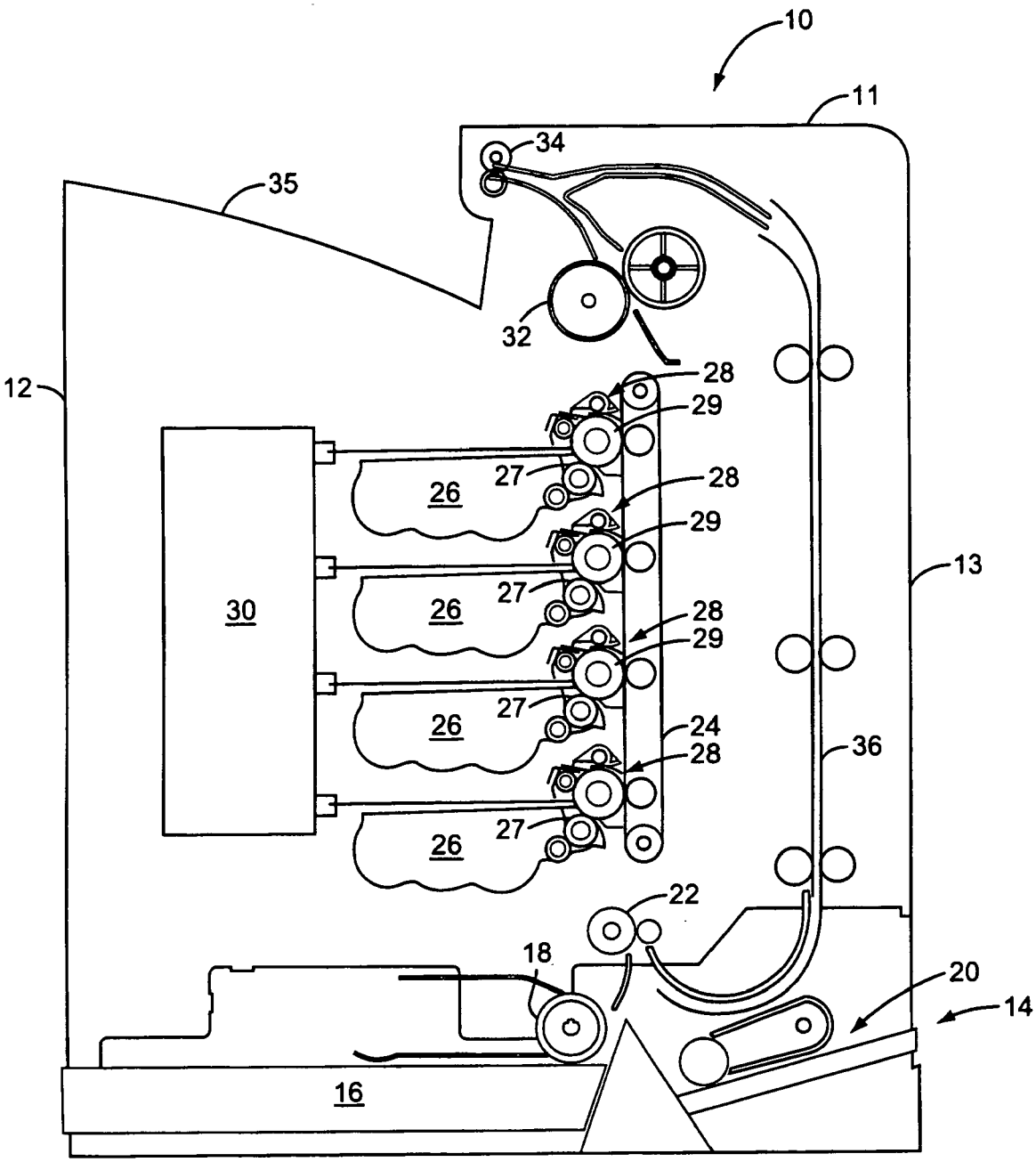
FIG. 1 is a schematic diagram of a representative image forming apparatus having a plurality of pairs of separate developer units and photoconductor units.

FIG. 1 depicts a representative image forming apparatus, indicated generally by the numeral 10. The image forming apparatus 10 comprises a body 12 with a top portion 11, subunit 13 and a media tray 14. The media tray 14 includes a main media sheet stack 16 with a sheet pick mechanism 18, and a manual input 20. The media tray 14 is preferably removable for refilling, and located on a lower section of the device 10.

Within the image forming apparatus body 12 and/or in the subunit 13, the image forming apparatus 10 includes registration rollers 22, a media sheet transfer belt 24, one or more removable developer units 26, a corresponding number of removable photoconductor units 28, an imaging device 30, a fuser 32, reversible exit rollers 34, and a duplex media sheet path 36, as well as various rollers, actuators, sensors, optics, and electronics (not shown) as are conventionally known in the image forming apparatus arts, and which are not further explicated herein.

The internal components of the developer units 26 and photoconductor units 28 are briefly described (these components are not all explicitly depicted in the drawings). Each developer unit 26 is a removable cartridge that includes a reservoir holding a supply of toner, paddles to agitate and move the toner, a toner adder roll for adding toner to a developer roll 27, a developer roll 27 for applying toner to develop a latent image on a (separate) photoconductive drum, and a doctor blade to regulate the amount of toner on the developer roll 27. Each photoconductor unit 28 is a separate removable cartridge that includes a photoconductive (PC) drum 29. The PC drum 29 may comprise, for example, an aluminum hollow-core drum coated with one or more layers of light-sensitive organic photoconductive materials. The photoconductor unit 28 also includes a charge roll for applying a uniform electrical charge to the surface of the PC drum 29, a photoconductor blade for removing residual toner from the PC drum 29, and an auger to move waste toner out of the photoconductor unit 28 into a waste toner container (not shown).

Each developer unit 26 mates with a corresponding photoconductor unit 28, with the developer roll 27 of the developer unit 26 developing a latent image on the surface of the PC drum 29 of the photoconductor unit 28 by supplying toner to the PC drum 29. In a typical color printer, three or four colors of toner—cyan, yellow, magenta, and optionally black—are applied successively (and not necessarily in that order) to a print media sheet to create a color image. Correspondingly, FIG. 1 depicts four pairs of developer units 26 and photoconductor units 28. Each of the developer units 26 and photoconductor units 28 include rollers, drums, augers, paddles, and/or similar generally cylindrical elements that are rotationally driven from a single rotational drive input by a drive train, such as a network of gears within or appended to the respective cartridge housing.

The operation of the image forming apparatus 10 is conventionally known. Upon command from control electronics, a single media sheet is "picked," or selected, from either the primary media stack 16 or the manual input 20. Alternatively, a media sheet may travel through the duplex path 36 for a two-sided print operation. Regardless of its source, the media sheet is presented at the nip of a registration roller 22, which aligns the sheet and precisely controls its further movement into the print path.

The media sheet passes the registration roller 22 and electrostatically adheres to transport belt 24, which carries the media sheet successively past the photoconductor units 28. At each photoconductor unit 28, a latent image is formed by the imaging device 30 and optically projected onto the PC drum 29. The latent image is developed by applying toner to the PC drum 29 from the developer roll 27 of the corresponding developer unit 26. The toner is subsequently deposited on the media sheet as it is conveyed past the photoconductor unit 28 by the transport belt 24.

The toner is thermally fused to the media sheet by the fuser 32, and the sheet then passes through reversible exit rollers 34, to land facedown in the output stack 35 formed on the exterior of the image forming apparatus body 12. Alternatively, the exit rollers 34 may reverse motion after the trailing edge of the media sheet has passed the entrance to the duplex path 36, directing the media sheet through the duplex path 36 for the printing of another image on the back side thereof.

Figure 2:
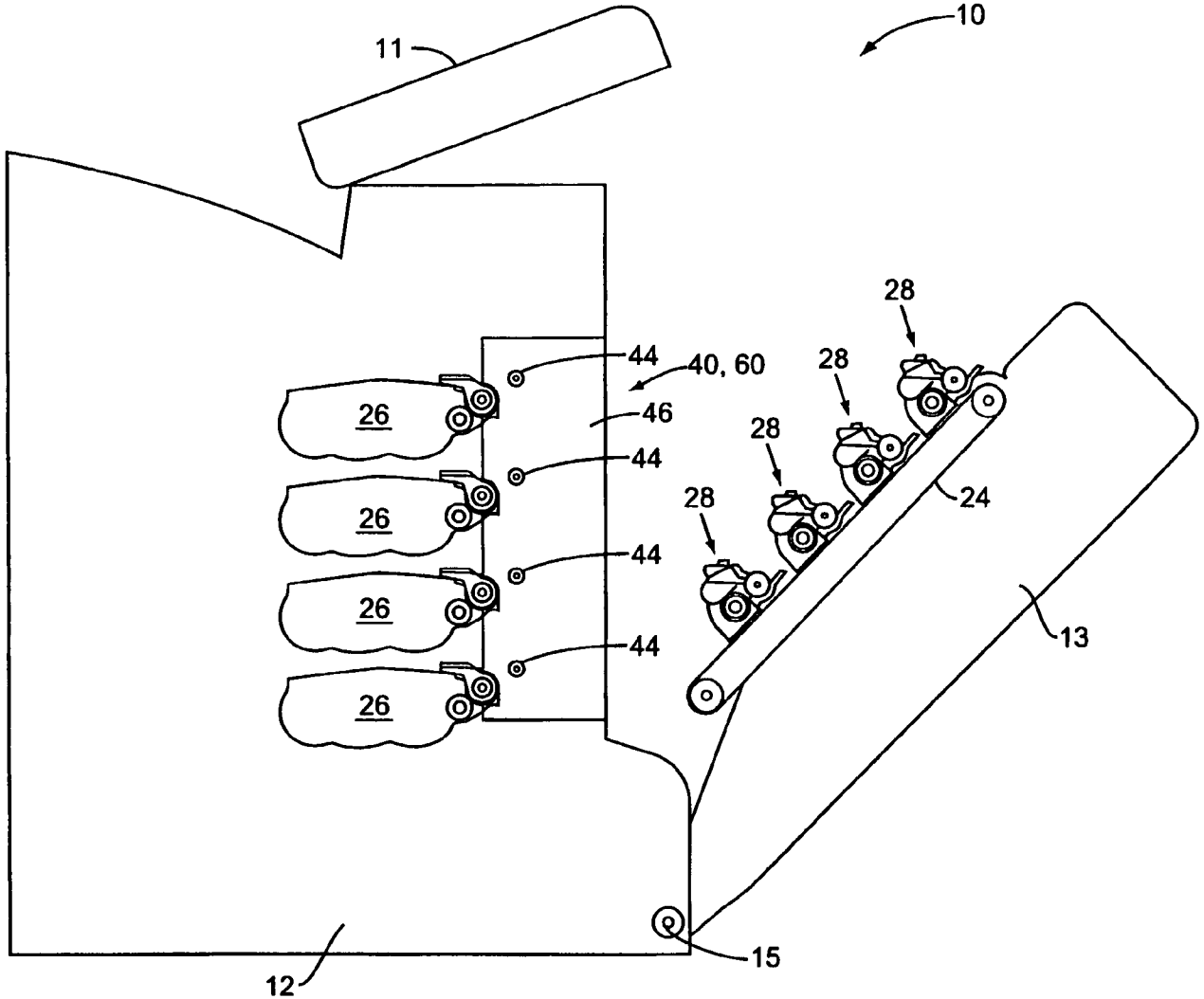
FIG. 2 is a schematic diagram of a representative image forming apparatus having a and openable and closable subunit.

FIG. 2 depicts an image forming apparatus 10 wherein a subunit 13 is separated from the main housing 12 by pivoting about a hinge point 15. At least the media sheet transport belt 24 and the photoconductor units 28 are mounted to the subunit 13. To allow the photoconductor units 28 to clear the housing 12 when the subunit 13 is opened, the photoconductor units 28 must first be decoupled from the drive mechanism couplings 44 within the housing 12 that supply rotary power to the photoconductor units 28. Additionally, to remove or insert a developer unit 26 from or into the housing 12, at least the developer unit 26 of interest must be decoupled from the drive mechanism coupling (not shown) that supplies rotary power to it. Furthermore, since the developer units 26 are inserted and removed from the housing 12 in a direction at right angles to the axes of the rollers within the cartridges, the drive mechanism couplings must be decoupled to provide mechanical clearance for the removal or insertion of the developer unit 26 cartridges.

Preferably, all of the drive mechanism couplings to all developer units 26 and photoconductor units 28 should be decoupled, or retracted, simultaneously, allowing any cartridge to be removed and/or replaced without the necessity of individually retracting its drive mechanism coupling. More preferably, the drive mechanism couplings should be automatically retracted from the cartridges whenever the subunit 13 is opened to allow access to the cartridges, without requiring conscious action on the part of the operator. According to various embodiments of the present invention, all of the drive couplers supplying rotary power to the developer units 26 and the photoconductor units 28 are retracted simultaneously, by actuation of a retraction plate 46 within a coupling retraction mechanism 40, 60, as described herein.

Figure 3:
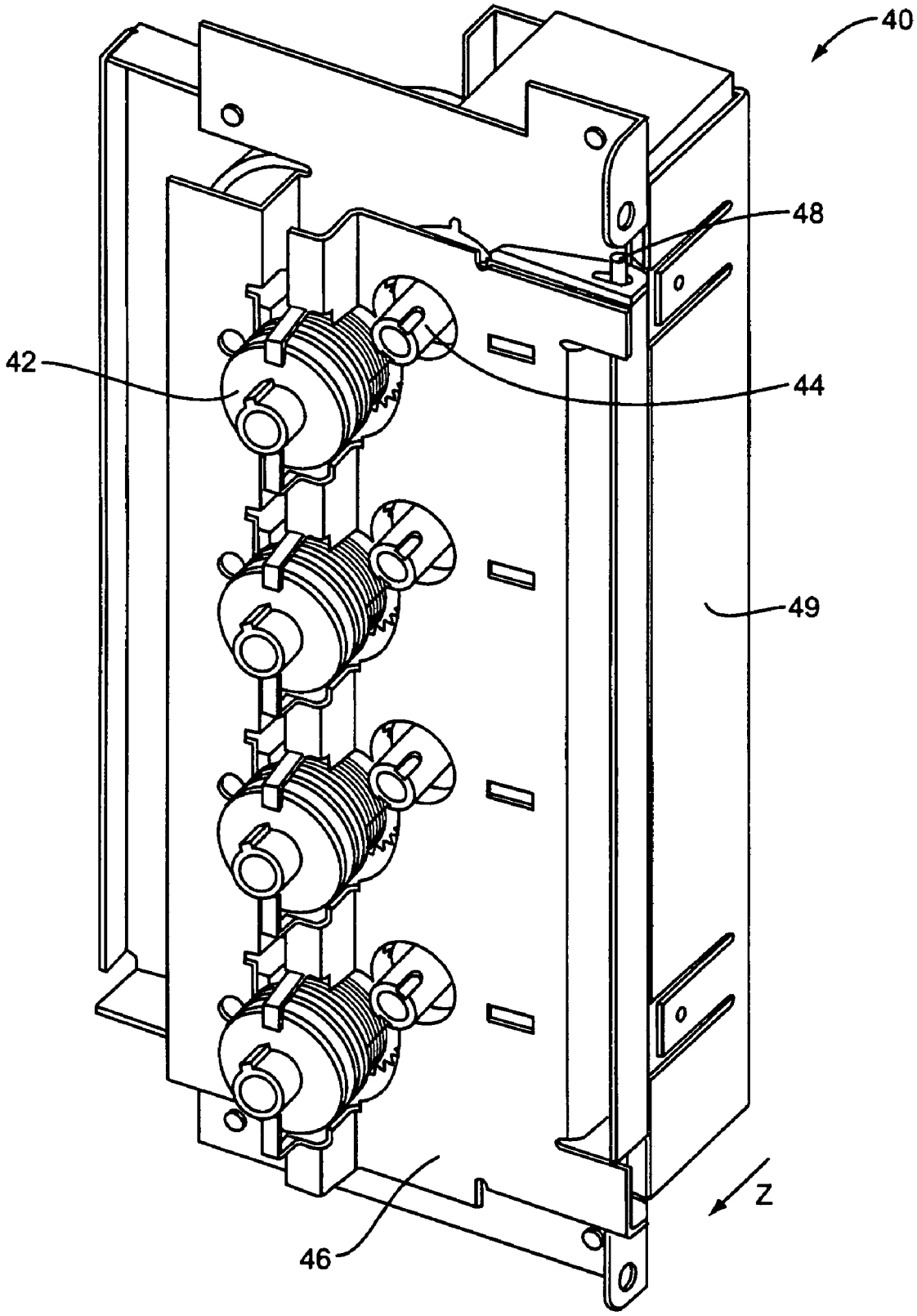
FIG. 3 is a perspective view of a pivoting coupling retraction plate assembly.

In particular, a pivoting coupling retraction mechanism according to one embodiment of the present invention is depicted in FIG. 3, indicated generally by the numeral 40. The pivoting coupling retraction mechanism 40 comprises a gearbox frame 49 housing various drive components such as motors, gears, and the like, and a pivoting retraction plate 46. Mounted to gearbox frame 49, and axially retained by the pivoting retraction plate 46, is a plurality of developer unit couplers 42, which mate with and provide rotational power to a corresponding plurality of developer units 26. In this embodiment, the developer unit couplers 42 comprise Oldham couplings, which are capable of transferring rotary power between two parallel, but not necessarily radially aligned, shafts. Additionally mounted to gearbox frame 49, and axially retained by the pivoting retraction plate 46, is a plurality of photoconductor unit couplers 44, each of which couples with and provides rotary power to a corresponding photoconductor unit 28.

The developer unit couplers 42 and photoconductor unit couplers 44 are biased in the positive z-direction (out of the page as depicted in FIG. 3), such as by springs. The couplers 42, 44 mate with their respective input members on the removable cartridges when the pivoting retraction plate 46 is in an engaged position, and are constrained in the positive z-direction by the pivoting retraction plate 46 when it is in a retracted position. According to the present invention, all developer unit couplers 42 and photoconductor unit couplers 44 (four of each in the embodiment depicted in FIG. 3) are simultaneously retracted in the negative z-direction (i.e., in an axial direction of the coupler shafts) as the pivoting retraction plate 46 moves from an engaged to a retracted position.

Figure 4A:
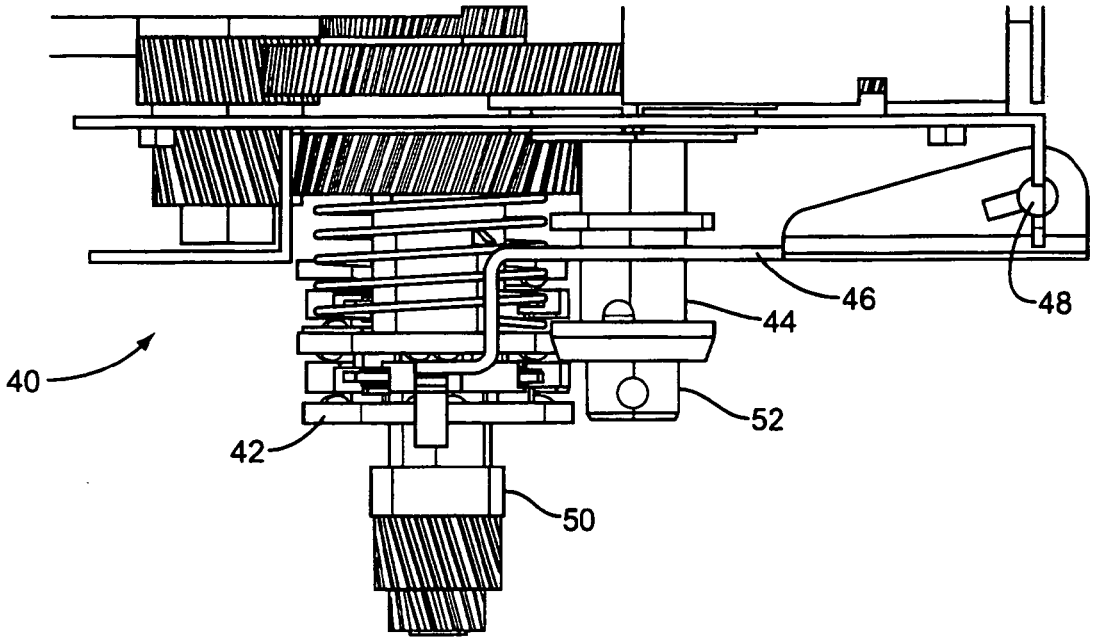
FIG. 4A is a top view of the pivoting coupling retraction plate assembly in an engaged position.
Figure 4B:
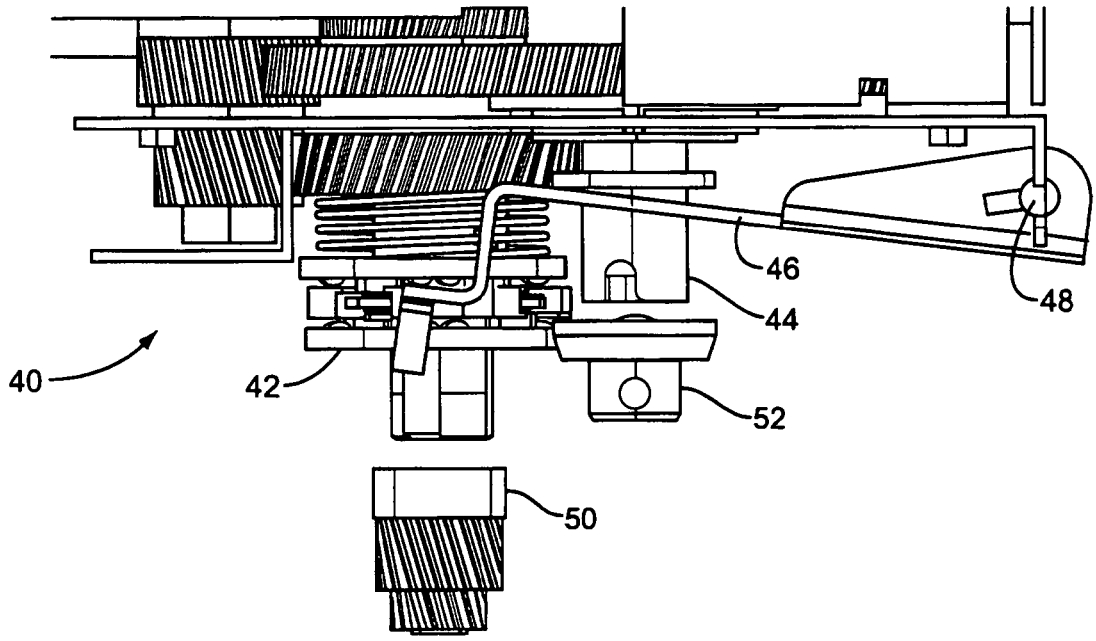
FIG. 4B is a top view of the pivoting coupling retraction plate assembly in a retracted position.

In the embodiment depicted in FIG. 3, the pivoting retraction plate 46 moves from an engaged to a retracted position by pivoting about a pivot rod 48. Preferably, the pivoting retraction plate 46 pivots through an angle between about 5° and 10°. FIGS. 4A and 4B depict the coupling retraction operation of the pivoting coupling retraction mechanism 40. In FIG. 4A, the mechanism 40 is in an engaged position, with the developer unit coupler 42 coupled to a developer unit drive receiver 50, which is affixed to the developer unit 26 (not shown). Additionally, the photoconductor unit coupler 44 is coupled to a photoconductor unit drive receiver 52, attached to a photoconductor unit 28 (not shown). Note that all (e.g., four) pairs of developer unit couplers 42 and photoconductor unit couplers 44 are simultaneously engaged.

FIG. 4B depicts the pivoting coupling retraction mechanism 40 in a retracted position, wherein the pivoting retraction plate 46 has rotated about the pivot pin 48. The pivoting retraction plate 46 retracts both the developer unit coupler 42 and the photoconductor unit coupler 44 laterally, in an axial direction, thus disengaging the couplers 42, 44 from the developer unit and photoconductor unit drive receivers 50, 52, respectively. With the couplers 42, 44 thus retracted, the subunit 13 holding the photoconductor units 28 may be opened (to facilitate the removal or installation of a photoconductor units 28), and the developer units 26 may be freely removed from, or inserted into, the housing 12 of the image forming apparatus 10.

Figure 5:
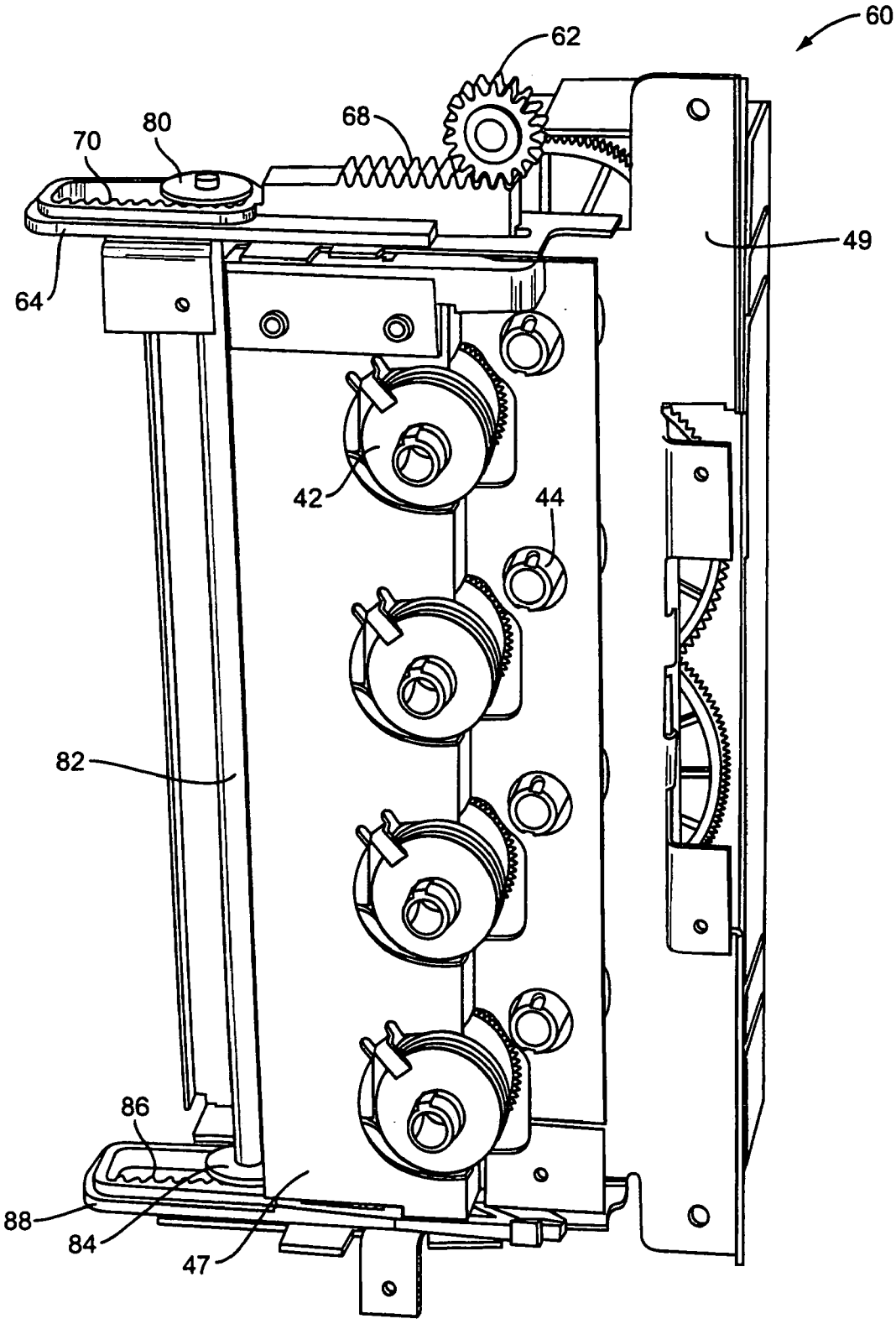
FIG. 5 is a perspective view of a translating coupling retraction plate assembly.

In another embodiment of the present invention, the retraction plate 47 is operative to move the developer unit couplers 42 and the photoconductor unit couplers 44 between engaged and retracted positions by translating in the axial direction of the couplers. FIG. 5 depicts a translating coupling retraction mechanism according to the present invention, indicated generally by the numeral 60. Similar to the pivoting coupling retraction mechanism 40, the translating coupling retraction mechanism 60 includes a gearbox assembly 49, a translating retraction plate 47, and a plurality of pairs of developer unit couplers 42 and photoconductor unit couplers 44. In addition, the translating coupling retraction mechanism 60 includes an upper rack plate 64 and lower rack plate 88, as depicted in greater detail in FIGS. 6 and 7, respectively.

Figure 6:
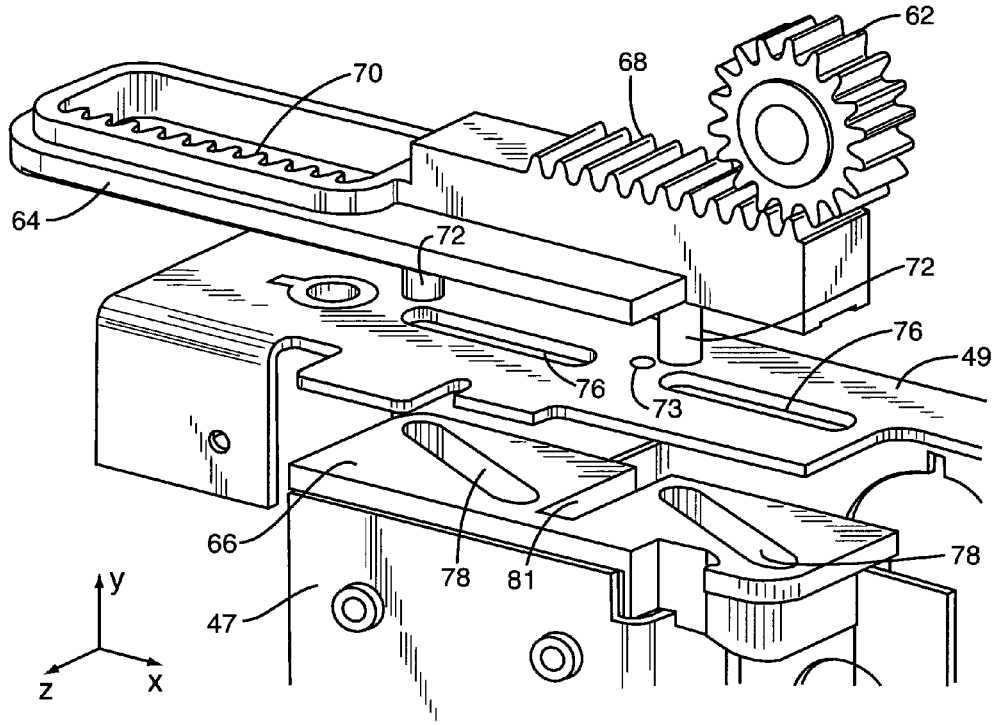
FIG. 6 is a partial perspective view of the upper plate assembly translating actuation mechanism.

FIG. 6 is an exploded perspective view of the translating coupling retraction mechanism 60, including the retraction plate 47, a retraction plate bracket 66 affixed to the retraction plate 47, the upper portion of the gear box assembly 49, an upper rack plate 64, and a drive gear 62.

The drive gear 62, preferably a spur gear as shown, is rotated in a counter-clockwise direction to retract the couplers 42, 44, such as when the top cover 11 is opened, a disengagement lever is actuated, or the like. The drive gear 62 meshes with a drive rack 68 (preferably a spur rack) to translate the rack plate 64 in the positive x-direction, or to the right as depicted in FIG. 6. The upper rack plate 64 is constrained to translation in the x-direction by the engagement of upper rack plate pins 72 in upper x-slots 76 formed in the gearbox frame 49. As the upper rack plate 64 is translated in the x-direction, the upper coordinating rack 70 turns the upper pinion 80 (see FIG. 5) in a counter-clockwise direction.

The upper rack plate pins 72 additionally engage in angled slots 78 formed in the retraction plate bracket 66. The angled slots 78 are disposed at an acute angle from the x-direction. As the upper rack plate 64 translates in the positive x-direction (to the right), the rack plate pins 72 exert a component of force on the angled slots 78 in the retraction plate bracket 66 in the negative z-direction, i.e., into the plane of the paper as depicted in FIG. 6. Since the retraction plate bracket 66 is affixed to the translating retraction plate 47, the translating retraction plate 47 is translated in the negative z-direction, i.e., in the axial direction of the couplers 42, 44. This translation retracts the couplers 42, 44 from the cartridge drive receivers 50, 52, similarly to the position depicted in FIG. 4B. Note that the translating retraction plate 47 is constrained to movement in the z-direction by a z-slot 81 formed in the retraction plate bracket 66, in which is engaged a pin (not shown) affixed to the gearbox frame 49, below the location 73 of FIG. 6.

Referring to FIG. 5, as the upper rack plate 64 translates in the positive x-direction (to the right), the upper pinion 80 is rotated counter-clockwise. The upper pinion 80 is connected via shaft 82 to the lower pinion 84. As the lower pinion 84 rotates counter-clockwise, it engages with the lower coordinating rack 86, formed in the lower rack plate 88, causing the lower rack plate 88 to translate in the positive x-direction (to the right as depicted in FIGS. 5 and 6), in coordination with the translation of the upper rack plate 64.

Figure 7:
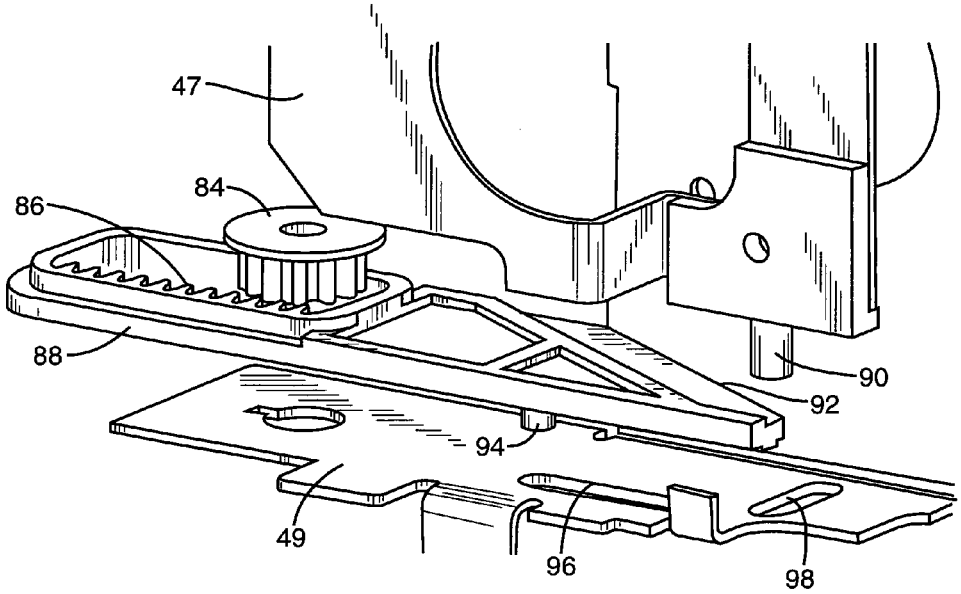
FIG. 7 is a partial perspective view of the lower plate assembly translating actuation mechanism.

Referring to FIG. 7, as the lower rack plate 88 translates in the positive x-direction (to the right), a pin 90 rigidly affixed to the translating retraction plate 47 is engaged by the sloped cam surface 92 of the lower rack plate 88. The angle of the sloped cam surface 92 with respect to the x-direction is preferably the same as that of the angled slots 78 formed in the retraction plate bracket 66 (see FIG. 5).

As the lower rack plate 88 translates in the positive x-direction (to the right), a force in the negative z-direction (i.e., into the plane of the page as depicted in FIG. 7) is exerted on the pin 90. Since the pin 90 is rigidly affixed to the translating retraction plate 47, the translating retraction plate 47 is translated in the negative z-direction, disengaging the drive couplers 42, 44 from their respective drive receivers 50, 52.

The lower rack plate 88 is constrained to motion in the x-direction by the engagement of a lower rack plate pin 94 in a lower x-slot 96 formed in the lower gearbox frame 49. In addition to engaging the sloped cam surface 92, the pin 90 additionally engages a z-slot 98 formed in the lower gearbox frame 49. This constrains the motion of the translating retraction plate 47 to the z-direction. That is, the translating retraction plate 47 is constrained to motion in the axial direction of the drive couplers 42, 44.

Following installation or removal of developer units 26 and/or photoconductor units 28, the subunit 13 is closed. This preferably rotates the drive gear 62 in the clockwise direction, which engages drive rack 68 and translates the upper rack plate 64 in the negative x-direction, or to the left as depicted in FIGS. 5–7. As the upper rack plate pins 72 (constrained to x-direction motion by x-slots 76) translate in the negative x-direction, they engage angled slots 78, moving the translating retraction plate 47 in the positive z-direction to engage couplers 42, 44 with drive receivers 50, 52.

Simultaneously, the upper coordinating rack 70 drives the upper pinion 80 and, via shaft 82, the lower pinion 84 in a clockwise direction. The lower pinion 84 engages lower coordinating rack 86 to translate the lower rack plate 88 in the negative x-direction. As the sloped cam surface 92 of the lower rack plate 88 translates in the negative x-direction, it allows the pin 90, and consequently the translating retraction plate 47, to translate in the positive z-direction, thereby engaging couplers 42, 44 with drive receivers 50, 52. Note that in this embodiment, the translating retraction plate 47 is biased to the positive z-direction, such as by one or more springs. Alternatively, the lower end of the translating retraction plate 47 may be actively forced to translate in the positive z-direction by the use of an angled slot (similar to angled slots 78 formed in the retraction plate bracket 66 as depicted in FIG. 6) in the lower rack plate 88, in lieu of the sloped cam surface 92. Such a straightforward modification would be readily apparent to one of ordinary skill in the art and would fall within the scope of the present invention.

The drive gear 62 is preferably driven in a counter-clockwise direction when the top cover 11 of the image forming apparatus 10 is opened, causing the couplers 42, 44 to automatically retract from the cartridge drive receivers 50, 52. This allows the subunit 13 to be opened (a mechanical interlock, not shown, prevents the subunit 13 from being opened until the top cover 11 is opened). Similarly, closing the top cover 11 (after closing the subunit 13) preferably rotates the drive gear 62 in a clockwise direction, translating the couplers 42, 44 to the engaged position. Alternatively, the drive gear 62 may be driven by a lever actuated by a user. As yet another alternative, the drive gear 62 may be driven by a motor, in response to a positive input by a user such as pressing a button or entering a command on a user interface, or in response to a condition or operation, such as attempting to open the subunit 13 some other access door or panel. In this manner, a plurality of rotational drive couplings 42, 44 are simultaneously engaged or disengaged with a corresponding plurality of removable cartridges 26, 28.

Referring back to FIG. 2, the coupling retraction mechanism 40, 60 may comprise either the pivoting coupling retraction mechanism 40 or the translating coupling retraction mechanism 60. In either case, rotary power is supplied to the developer units 26 in the housing 12 by developer unit couplers 42 (not shown), and to the photoconductor units 28 on the subunit 13 by photoconductor unit couplers 44 when the subunit 13 is closed. When the top cover 11 is again opened (allowing the subunit 13 to be opened), the developer unit couplers 42 and photoconductor unit couplers 44 are retracted. In this manner, the plurality of rotational drive couplings 42, 44 are simultaneously engaged or disengaged with the corresponding plurality of removable cartridges 26, 28.

Figure 8:
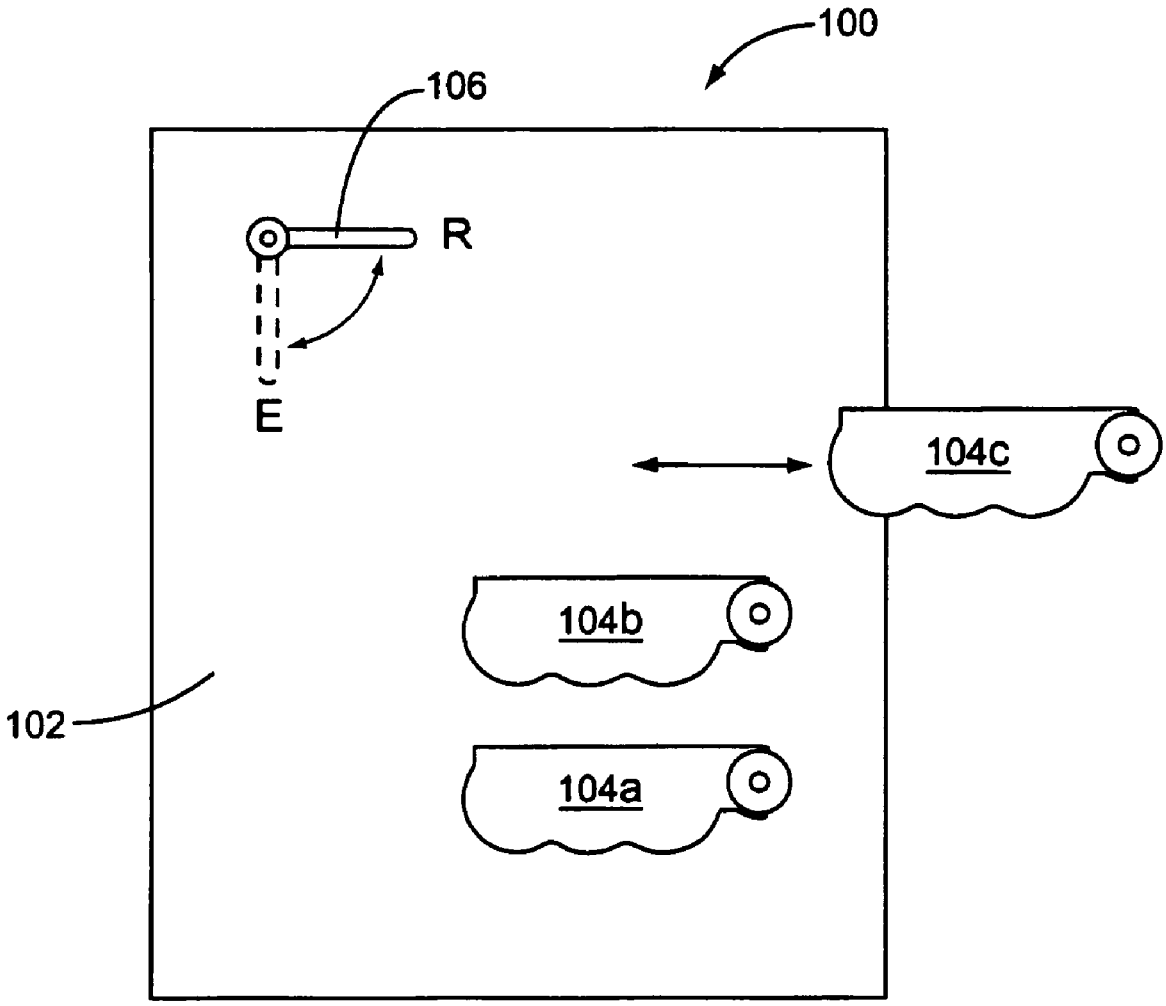
FIG. 8 is a schematic diagram of a representative image forming apparatus having three removable cartridges and a cartridge decoupling lever.

Although described herein with reference to an image forming apparatus 12 having plural, separate developer units 26 and photoconductor units 28, the present invention is not limited to such an embodiment. For example, FIG. 8 depicts, in schematic block diagram form, an image forming apparatus 100, having a housing 102 and a plurality (in this embodiment, three) of integrated, removable image forming cartridges 104. Cartridges 104 are well known in the art, and generally include at least a toner reservoir, optionally various paddles and augers, a developer roller, a charger roll and a photoconductive drum. FIG. 8 depicts two image forming cartridges 104*a* and 104*b* disposed in the housing 102, with a third image forming cartridge 104*c* being inserted into or removed from the image forming apparatus 100 (in a direction that is at right angles to the axes of the rotational members within the cartridge 104). The image forming apparatus 100 includes an external lever 106 movable between positions marked, e.g., engaged and retracted. Upon the insertion of all image forming cartridges 104 within the housing 102, a user moves the lever from the retracted to engaged position. The lever is mechanically linked to a coupling retraction mechanism 40, 60 of the present invention that is operative to simultaneously engage or disengage a rotary drive mechanism with each image forming cartridge 104.

The present invention is not limited to the coupling of a rotary drive shaft to a removable cartridge. Rather, the present invention may be advantageously utilized to simultaneously, removably couple a plurality of rotary drive shafts and drive receivers, as may be necessary or desired within the image forming apparatus 10.

As used herein, the term roller refers to a generally cylindrical element, which may for example and without limitation include an auger or paddle, a toner supply roller, a developer roller, a charge roller or a photoconductive drum. The term photoconductive member refers to any element in an image forming apparatus on which a latent image is formed by incident optical energy, the latent image being developed by toner or developer. The term developer member refers to any element in an image forming apparatus that supplies toner or developer to develop a latent image on a photoconductive member. The term subunit refers to a subassembly of the image forming apparatus 10, which may for example and without limitation comprise a door, an access panel or the like. Opening or closing the subunit refer to the operations of uncoupling and separating the subunit from the main housing of the image forming apparatus, and of operatively engaging the subunit with the image forming apparatus, respectively. The terms coupling and coupler are used interchangeably herein.

Although the present invention has been described herein with respect to particular features, aspects and embodiments thereof, it will be apparent that numerous variations, modifications, and other embodiments are possible within the broad scope of the present invention, and accordingly, all variations, modifications and embodiments are to be regarded as being within the scope of the invention. The present embodiments are therefore to be construed in all aspects as illustrative and not restrictive and all changes coming within the meaning and equivalency range of the appended claims are intended to be embraced therein.

What is claimed is:

1. An image forming apparatus, comprising:

a plurality of rollers, disposed with generally parallel axes;

a retraction plate movable in a substantially axial direction relative to said rollers between engaged and retracted positions; and a plurality of rotational couplings moved by said retraction plate, each said rotational coupling operative to transmit a rotary force to one of said rollers when said retraction plate is in said engaged position;

whereby said couplings move laterally in an axial direction of said rollers as said retraction plate moves between said engaged and retracted positions.

2. The image forming apparatus of claim 1 wherein said rollers comprise at least one photoconductive member.

3. The image forming apparatus of claim 1 wherein said rollers comprise at least one developer member.

4. The image forming apparatus of claim 1 wherein said rollers comprise at least one removable cartridge including both a developer member and a photoconductive member.

5. The image forming apparatus of claim 1 wherein said rollers comprise at least one pair of removable cartridges, one said cartridge including a developer member and the other said cartridge including a photoconductive member.

6. The image forming apparatus of claim 1 wherein said rotational couplings comprise Oldham couplers.

7. The image forming apparatus of claim 1 wherein said retraction plate moves between said engaged and retracted positions in response to an applied force.

8. The image forming apparatus of claim 7 wherein said applied force is generated by a user opening a portion of said image forming apparatus.

9. The image forming apparatus of claim 1 wherein said retraction plate pivots about a pivoting axis to move between said engaged and retracted positions.

10. The image forming apparatus of claim 9 wherein said pivoting axis is disposed along one edge of said retraction plate.

11. The image forming apparatus of claim 1 wherein said retraction plate moves laterally between said engaged and retracted positions.

12. A pivoting coupling retraction mechanism for an image forming apparatus, comprising:

a pivoting retraction plate having a pivoting axis and movable between engaged and retracted positions by pivoting about said axis; and a plurality of rotational couplings moved by said retraction plate, operative to couple rotational forces to a corresponding plurality of rollers disposed in said image forming apparatus when said retraction plate is in said engaged position, each of the plurality of rollers being disposed in a substantially parallel configuration, the pivoting axis oriented substantially orthogonal to the plurality of rollers.

13. The mechanism of claim 12 wherein said pivoting retraction plate pivots about said pivoting axis in response to an applied force.

14. The mechanism of claim 13 wherein said applied force is generated by a user opening a portion of said image forming apparatus.

15. The mechanism of claim 12 wherein said rollers comprise at least one developer member and at least one photoconductive member.

16. A translating coupling retraction mechanism for an image forming apparatus, comprising:

a retraction plate movable between engaged and retracted positions;

a plurality of rotational couplings moved by said retraction plate, operative to couple rotational forces to a corresponding plurality of rollers disposed in said image forming apparatus when said retraction plate is in said engaged position; and an articulating member movable in a first lateral direction along said retraction plate;

wherein movement of said articulating member in said first lateral direction is operative to translate said retraction plate in a second lateral direction generally orthogonal to said first lateral direction and generally parallel to an axis through one of the plurality of rollers, thereby moving said plate between said retracted and engaged positions.

17. The mechanism of claim 16 wherein said retraction plate is disposed in a generally vertical orientation.

18. The mechanism of claim 16 wherein said articulating member includes at least one pin.

19. The mechanism of claim 18 further comprising a fixed bracket, and wherein said articulating member is constrained to motion in said first lateral direction by engaging said at least one pin in a slot in said fixed bracket, said slot oriented along said first lateral direction.

20. The mechanism of claim 18 wherein said retraction plate is translated in said second lateral direction by engaging said at least one pin with a cam surface attached to said retraction plate, said cam surface orientated at a non-zero, acute angle with respect to said first lateral direction.

21. The mechanism of claim 20 wherein said cam surface is oriented at a generally less than 45-degree angle with respect to said first lateral direction.

22. The mechanism of claim 21 further comprising a retraction plate bracket affixed to said retraction plate, and wherein said cam surface is an inner surface of a slot formed in said retraction plate bracket.

23. The mechanism of claim 16 wherein said rotational couplings include at least one Oldham coupler.

24. The mechanism of claim 16 wherein said rollers include at least one developer member.

25. The mechanism of claim 16 wherein said rollers include at least one photoconductive member.

26. The mechanism of claim 16 wherein said articulating member moves in said first lateral direction in response to an applied force.

27. The mechanism of claim 26 wherein said applied force is a rotary force.

28. The mechanism of claim 27 wherein said rotary force is converted to a lateral force by a rack and pinion gear system.

29. The mechanism of claim 26 wherein said applied force is generated by a user opening a portion of said image forming apparatus.

30. A method of installing a removable cartridge in an image forming apparatus, said cartridge receiving rotary force from a coupling in said image forming apparatus, comprising:

moving said coupling to a retracted position by moving a retraction plate to contact and retract said coupling;

inserting said cartridge in said image forming apparatus in a direction at right angles to the axial direction of said coupling; and moving said coupling to an engaged position in which said coupling transfers rotary power to said cartridge, by moving said retraction plate in the axial direction of said coupling such that said coupling moves in an axial direction towards said cartridge.

31. The method of claim 30 wherein moving said retraction plate to contact and retract said coupling comprises pivoting said retraction plate about a pivot axis spaced apart from said coupling.

32. The method of claim 30 wherein moving said retraction plate to contact and retract said coupling comprises translating said retraction plate in the axial direction of said coupling.

33. The method of claim 30 wherein translating said retraction plate in the axial direction of said coupling comprises translating an articulating member in a direction orthogonal to the axial direction of said coupling, said articulating member engaging said retraction plate at least one cam surface disposed at a non-zero, acute angle to the direction of said articulating member translation, so as to urge said retraction plate in the axial direction of said coupling.

34. An image forming apparatus, comprising:

a housing;

four first cartridges removably disposed in said housing, each including a developer member;

four second cartridges removably disposed in said housing, each including a photoconductive member;

four first couplers disposed in said housing, movable in the axial direction thereof between retracted and engaged positions and operative to supply rotary power to said four first removable cartridges in said engaged position;

four second couplers disposed in said housing, movable in the axial direction thereof between retracted and engaged positions and operative to supply rotary power to said four second removable cartridges in said engaged position; and a retraction plate disposed in said housing, operative to simultaneously move said four first couplers and said four second couplers between said retracted and engaged positions;

wherein all eight said couplers are substantially parallel.

35. The image forming apparatus of claim 34 wherein said retraction plate is operative to pivot about a pivot axis spaced apart from said first and second couplers, said pivoting operative to move said couplers between said retracted and engaged positions.

36. The image forming apparatus of claim 34 wherein said retraction plate is operative to translate in the axial direction of said couplers, said translation operative to move said couplers between said retracted and engaged positions.

37. The image forming apparatus of claim 36 further comprising:

an articulating member movable in a direction orthogonal to the axial direction of said couplers;

at least one first pin disposed on said articulating member, said first pin engaging an angled cam surface disposed at a non-zero, acute angle with respect to the axial direction of said couplers, said angled cam surface rigidly affixed to said retraction plate, such that said first pin exerts a force on said angled cam surface in the axial direction of said couplers when said articulating member moves in a direction orthogonal to the axial direction of said couplers.

38. The image forming apparatus of claim 37 wherein said angled cam surface is an interior surface of an angled slot formed in a bracket affixed to said retraction plate.

39. The image forming apparatus of claim 37 further comprising:

at least one second pin fixed with respect to said housing, said second pin engaging an axial cam surface disposed in the axial direction of said couplers, said axial cam surface rigidly affixed to said retraction plate, such that said second pin is operative to restrict motion of said retraction plate to the axial direction of said couplers.

40. The image forming apparatus of claim 39 wherein said axial cam surface is an interior surface of an axial slot formed in a bracket affixed to said retraction plate.

* * * * *